United States Patent [19]

Robertson et al.

[11] Patent Number: 4,916,937

[45] Date of Patent: Apr. 17, 1990

[54] PRESSURE BARRIER LINER

[75] Inventors: Andrew M. Robertson, West Vancouver; Walter Van Woudenberg, Winterburn, both of Canada

[73] Assignee: Robertson Barrier Systems Corporation, Vancouver, Canada

[21] Appl. No.: 51,740

[22] Filed: May 18, 1987

Related U.S. Application Data

[63] Continuation-in-part of Ser. No. 877,116, Jun. 23, 1986, abandoned.

[51] Int. Cl.[4] ..... B65D 90/04

[52] U.S. Cl. ..... 405/270; 52/169.7; 52/169.14; 405/55; 405/128

[58] Field of Search ..... 52/169.7; 405/270

[56] References Cited

U.S. PATENT DOCUMENTS

| | | | |
|---|---|---|---|
| 3,866,670 | 2/1975 | Cramer et al. . | |
| 4,154,549 | 5/1979 | Zaslavsky et al. | 405/38 |
| 4,207,017 | 6/1980 | Jarrell . | |
| 4,332,073 | 6/1982 | Yoshida et al. . | |
| 4,335,978 | 6/1982 | Mutch . | |
| 4,345,581 | 8/1982 | Shacher . | |
| 4,352,601 | 10/1982 | Valiga et al. | 52/169.7 X |
| 4,421,698 | 12/1983 | Vanderlans . | |
| 4,561,292 | 12/1985 | Pugnale et al. . | |

FOREIGN PATENT DOCUMENTS

| | | | |
|---|---|---|---|
| 0082629 | 6/1983 | European Pat. Off. . | |
| 3444895 | 6/1986 | Fed. Rep. of Germany . | |
| 2436860 | 4/1980 | France . | |
| 1561320 | 2/1980 | United Kingdom . | |
| 2150022 | 6/1985 | United Kingdom | 52/169.7 |
| 86/04943 | 8/1986 | World Int. Prop. O. . | |

OTHER PUBLICATIONS

Giroud, Geotextiles and Geomembranes Definitions, Properties and Design; Impermeability the Myth and a Rational Approach; Intl. Conf. On Geomembranes; Jun. 20–24, 1984.

*Primary Examiner*—Tom Noland
*Assistant Examiner*—Joseph W. Roskos
*Attorney, Agent, or Firm*—Chernoff, Vilhauer, McClung & Stenzel

[57] ABSTRACT

A pressure barrier liner is an assembly of low permeability membranes disposed on above the other. A region is encapsulated between each adjacent pair of membranes. A pressurized fluid such as air or water is introduced into a selected group of the encapsulated regions to pressurize them to a selected pressure or pressures, thereby ensuring that any flow through the membranes or through disruptions in the membranes will be from within the pressurized regions to the regions outside the membranes which encapsulate the pressurized regions, rather than from the fluid storage region above the membranes, through the membranes and into the region beneath the membranes which is to be protected by the linear. Alternatively, a selected group of the encapsulated regions may be depressurized to a selected pressure or pressures, thereby ensuring that any fluid flow through disruptions in the membranes is withdrawn, thus again preventing fluid escapement from the fluid containment region above the membranes, through the membranes and into the region beneath the membranes which is to be protected by the liner.

28 Claims, 14 Drawing Sheets

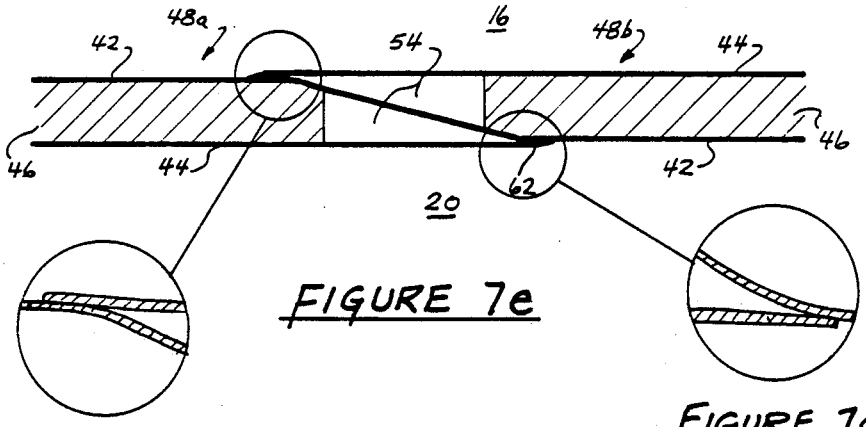
FIGURE 7e
FIGURE 7f
FIGURE 7g
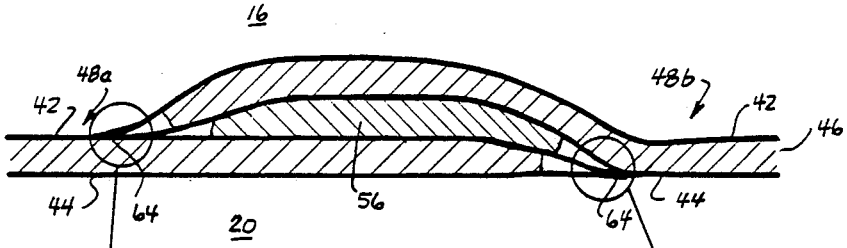
FIGURE 7h
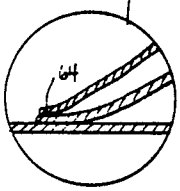
FIGURE 7i
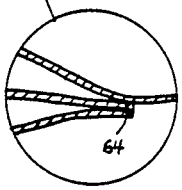
FIGURE 7j

PRESSURE BARRIER LINER

REFERENCE TO RELATED APPLICATION

This is a continuation-in-part of U.S. application Ser. No. 877,116 filed June 23, 1986, and now abandoned.

FIELD OF THE INVENTION

This application pertains to pressure barrier liners for containment of valuable and/or hazardous and/or polluting fluid or solid waste materials. More particularly, the application pertains to pressure barrier liners having membranes which encapsulate regions of relatively high permeability such that the regions may be pressurized or depressurized to pressure levels sufficient to create a barrier which substantially prevents fluid escapement through the liner. Pressure barrier liners constructed in accordance with the invention may also be tested to assess their integrity, to determine whether they are leaking, and to assess their capability to retain fluids or prevent leakage in the absence of such pressurization or depressurization.

BACKGROUND OF THE INVENTION

Membrane or sheet liners are commonly used to line excavations or other containment facilities to prevent escapement therefrom of hazardous and/or polluting fluid wastes, solid waste leachates or valuable fluids. Such materials must be stored at the lowest possible cost on either a short term or a long term basis. Membrane liners consist of a number of membranes or flexible sheets of liner material joined together at their edges and joined to bounding structures to yield a continuous liner interposed between the fluid to be contained and the surroundings into which flow of the contained fluid is to be prevented.

Conventional membrane liners have a finite permeability and may suffer from a number of imperfections including holes in the membrane or sheet material which are inadvertently produced during manufacture of the material; holes which are inadvertently caused during the process of construction of the liner from the sheet or membrane material or during the process of installing the liner in the excavation or other containment region; imperfections in the welds or seams used to join adjacent segments of membrane or sheet material to form the liner; and, holes which develop in the liner after it is installed, due to punching, shearing, settling, chemical attack and a variety of other causes.

Liners are conventionally subjected to fluid pressures from both sides of the liner. Ambient air pressure subjects both sides of the liner to a first fluid pressure. Since this pressure is normally equal on both sides of the liner it does not produce a significant pressure gradient across the liner and therefore does not induce significant flow through the liner. Fluids contained in the region above the liner exert a second fluid pressure on the upper surface of the liner. Ground water in the region beneath the liner exerts a third fluid pressure on the lower surface of the liner. Accordingly, liners are conventionally subjected to fluid pressure gradients caused by the differential between the second and third fluid pressures. If the fluid pressure above the liner exceeds that beneath the liner, fluid will flow from the fluid containment region above the liner through any disruptions in the liner (i.e. holes, imperfect seams, etc.) and into the region beneath the liner, thus defeating the objective of the liner, which is to prevent such fluid escapement.

In practice, all liners have a finite permeability due to the inherent porosite of the material used to construct the liner. Accordingly, all liners leak at a small but finite rate. If holes are inadvertently made in the liner, or if the seams which join adjacent segments of liner material are imperfect, then the rate of leakage may increase dramatically and it is such increased leakage which is desirably prevented. In the prior art, high security composite liners have been constructed with double or even triple layers of liner material. Drainage layers are typically established between layers of liner material. Fluid which escapes through the uppermost liner passes into the drainage layer beneath the uppermost liner and flows towards drainage collection points established in the drainage layer. However, if holes occur in the liner located immediately beneath the drainage layer than secondary leakage may occur through the lower liner. If the leakage rate through the uppermost liner is sufficiently rapid then a localized fluid pressure may develop within the drainage layer and consequential high rates of leakage can occur through the lower liner before the fluid escaping through the uppermost liner can be collected and removed by the drainage system.

In practice, it is difficult to determine the rate of leakage through a field installed liner, particularly if the leakage rate is relatively low and particularly if a composite liner, comprised of multiple layers of liner material is involved. Large fluid losses may occur before the leakage is detected. If the stored fluid is valuable, or hazardous, or would produce a particularly undesirable impact on the surrounding environment, then such leakage should idealy be prevented. It is also desirable that the liner system be testable to determine whether the potential for leakage exists so that steps can be taken to prevent leakage.

The present invention provides a pressure barrier liner which significantly reduces the possibility of leakage through the liner, while facilitating testing of the liner to determine whether leakage could occur through the liner, even at relatively low leakage rates.

SUMMARY OF THE INVENTION

The invention provides a liner comprising a plurality of low permeability flexible membranes disposed one above the other. Separate regions are encapsulated between each adjacent pair of membranes. A pressurizing means may be used to pressurize a selected group of the encapsulated regions to a selected pressure or pressures. A depressurizing means may also or may alternatively be used to depressurize a selected group of the encapsulated regions to a selected pressure or pressures.

A relatively high permeability flexible membrane may be disposed outside the outermost of the low permeability membranes to encapsulate a region between the high permeability membrane and at least one outer surface of the liner. A depressurizing means may be provided for depressurizing the region between the high permeability membrane and the liner outer surface.

The encapsulated regions may contain a relatively high permeability core material which may be connected to the adjacent membranes which encapsulate the material to give the liner sufficient strength to resist tensile stresses which could cause the membranes to separate. As an alternative to core material, the membranes may be textured such that contact between the membranes does not obstruct fluid flow within the encapsulated regions. The textured membranes may also be connected together to enable the liner to resist tensile stresses.

A drainage means may extend within a selected group of the encapsulated regions for withdrawing liquids from within those regions. A layer of geotextile material may be disposed outside at least one of the outermost of the membranes to inhibit passage of particulate materials into the liner.

A composite liner may be constructed by providing a first plurality of low permeability flexible membranes disposed one above the other with separate regions encapsulated between each adjacent pair of membranes. For each one of the first plurality of membranes, a second plurality of low permeability membranes is disposed beside said one membrane; and, separate regions are encapsulated between each vertically adjacent pair of the second plurality of membranes. The liner may be extended to attain any desired size and shape by similarly providing further pluralities of vertically layered membranes beside the existing multiple membrane liner.

The invention also provides a connector means for sealingly connecting edges of liner membranes disposed beside one another. The connector means further facilitates selective fluid communication between encapsulated regions.

The pressurizing means may comprise a floating constant head apparatus for floating in fluid contained by the liner and for applying a constant low positive head pressure within a selected group of encapsulated regions. The depressurizing means may comprise a vacuum pump for applying a low negative head pressure within a selected group of encapsulated regions.

The invention also provides a method of testing for leakage of a liner during construction of the liner. The method comprises the steps of disposing first and second low permeability membranes one above the other to encapsulate a region therebetween. The encapsulated region is then pressurized or depressurized to a selected pressure (alternatively, a detectable fluid is injected into the encapsulated region). The pressure within the region is then monitored (or the region is monitored for escape of detectable fluid therefrom). If the region maintains pressure (or contains the detectable fluid) then it may be determined that the membranes are not leaking. However, if the region fails to maintain the selected pressure (or fails to contain the detectable fluid) then the uppermost of the membranes is inspected to locate leaks therein which are then repaired. The pressurization and monitoring steps are then repeated. If the region still fails to maintain the selected pressure (or to contain the detectable fluid) then the lowermost membrane is inspected to locate leaks therein which are then repaired. A further low permeability membrane is then disposed above the uppermost membrane to encapsulate a further region between the further and uppermost membranes. The pressurization, monitoring, inspecting and repair steps are then repeated with respect to the further region so established. Additional low permeability membranes are then added and tested as aforesaid until the liner comprises a selected plurality of low permeability membranes disposed one above the other with separate regions encapsulated between each adjacent pair of membranes.

BRIEF DESCRIPTION OF THE DRAWINGS

FIGS. 7*a* through 7*j* illustrate alternative liner panel joints.

FIG. 1O*a* is a top plan view of a containment pond having a multiple cell dual membrane liner which has been shaped and sized to fit the containment pond excavation.

FIG. 1O*b* is a cross-sectional view taken with respect to line A—A of FIG. 10*a*.

DETAILED DESCRIPTION OF THE PREFERRED EMBODIMENTS

A background discussion will first be provided with reference to the prior art. Dual membrane pressurized and depressurized liners will then be described, together with techniques for joining adjacent liner panels to construct liners of desired sizes and shapes. Techniques for liner leakage detection will then be described. A detailed description of connecting strips will then be provided in the context of dual membrane liners. A "shingling" technique for constructing dual membrane liners is then described. This is followed by a description of a dual membrane liner having multiple cells. Multiple membrane liners are then described, together with connecting strips and leakage detection and liner construction techniques specifically adapted to multiple membrane liners.

Background and Prior Art

Figure 1:
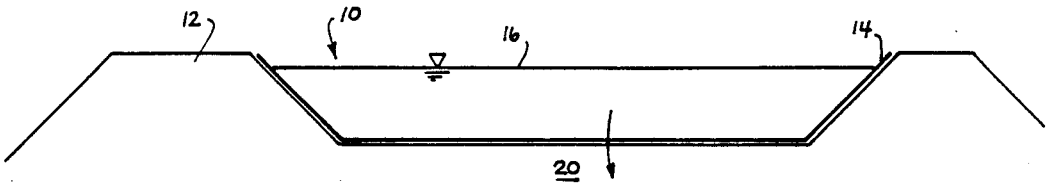
FIGURE 1 PRIOR ART
FIG. 1 is a simplified cross-sectional side view of a typical prior art liner positioned within an excavation to contain fluid in a containment pond.
Figure 2:
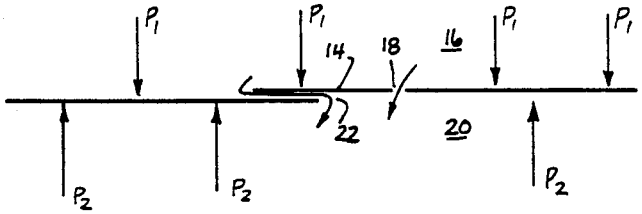
FIGURE 2 PRIOR ART
FIG. 2 is a simplified diagram which illustrates the potential escapement of fluids through holes or imperfect seams in the liner of FIG. 1.

FIG. 1 illustrates a prior art fluid containment pond comprising excavation 10 which is surrounded by embankment 12 and lined with a liner 14 formed of material such as polyvinyl chloride, high or low density polyethylene, butyl rubber, chlorinated polyethylene, elasticized polyolefin, polyamide, chlorosulphonated polyethylene, or other material suitable for potential long term containment of valuable, hazardous or pollutant fluid 16. Conventionally, liner 14 is formed by joining together several segments or sheets of liner material using heat welding, extrusion welding, solvent welding or bonding, adhesive bonding, ultrasonic welding, dielectric welding, electro-magnetic welding, or other known techniques for joining such materials to form a single composite liner. However, as illustrated in FIG. 2, holes 18 may be inadvertently made in liner 14 during manufacture of the liner material, during formation of the liner, during installation of the liner, or after the liner has been installed; thereby allowing fluid 16 to leak through hole 18 into the region 20 beneath liner 14, which is desirably avoided. Similarly, imperfections in the seams or welds used to join adjacent sheets or segments of liner material together may result in flow channels or paths as illustrated by reference number 22 in FIG. 2, enabling further leakage of fluid 16 through liner 14 and into region 20. If disruptions such as holes 18 or seam imperfections 22 exist in liner 14 then leakage will occur if the pressure component "$P_1$" exerted on the upper surface of liner 14 by fluid 16 exceeds the pressure component "$P_2$" exerted on the lower surface of liner 14 by fluid (i.e. ground water) in region 20.

Figure 3:
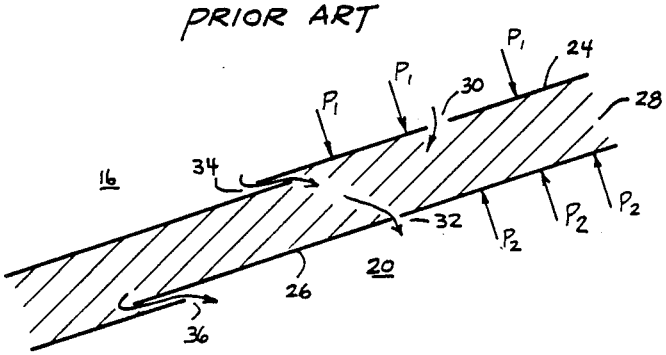
FIGURE 3 PRIOR ART
FIG. 3 is a simplified cross-sectional side view of a potion of a prior art liner having inner and outer membranes and having a drainage layer between the membranes.

FIG. 3 is a cross-sectional side view of a portion of a prior art double liner having first and second liners 24, 26 between which a drainage layer 28 formed of material such as sand is established. Here again, holes 30, 32 and/or seam/weld imperfections 34, 36 can result in escapement of fluid 16 through liner 24 into drainage layer 28 and thence through liner 26 into region 20 if the pressure $P_1$ exerted on liner 24 by fluid 66 exceeds the pressure $P_2$ exerted on liner 26 by fluid in region 20. If a drainage system is installed in drainage layer 28 then a reduced pressure "$P_3$" results in drainage layer 28. The value of $P_3$, while small, is always positive and may be increased where the geometry or the permeability of drainage layer 28 is such that increased pressure heads are required to achieve the flow rates necessary to drain fluids which enter drainage layer 28 through holes/imperfections 30, 34 in first liner 24. If $P_1$ is greater than $P_3$, and if $P_3$ is greater than $P_2$, then fluid 16 will flow through holes 30 and seam imperfections 34 into drainage layer 28; part of which flow will be drained away by the drainage system and part of which will escape through second liner 26 through holes 32 and seam imperfections 36 to region 20. In practice, $P_2$ is seldom greater than $P_3$ over the entire extent of second liner 26.

Dual Membrane Pressurized Liner

Figure 4:
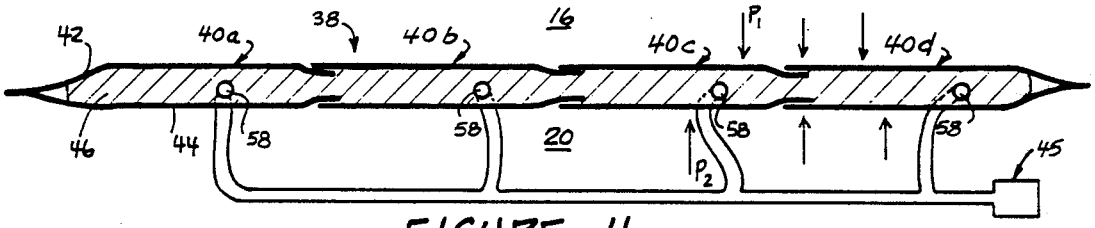
FIG. 4 is a cross-sectional side view of a portion of a dual membrane pressurized liner.

FIG. 4 illustrates a dual membrane pressure barrier liner 38 comprising a plurality of liner panels **40*a*, 40*b*, 40*c*, etc. Each liner panel in turn comprises dual (i.e. first and second) low permeability flexible membranes 42, 44 disposed one above the other. The term "above" is used in the relative sense. Membranes 42, 44 may for example be oriented one beside the other if liner 38 is placed against a vertical sidewall of a containment pond. As in the case of the prior art liners, membranes 42, 44** may be formed of any suitable material such as high or low density polyethylene, polyvinyl chloride, chlorinated polyethylene, elasticized polyolefin, polyamide, chlorosulphonated polyethylene, rubbers, Hypalon, butyl rubber, asphalt, concrete, soil cement or other suitable low permeability materials. In the context of the present invention the term "low permeability" means a material having an overall permeability of less than $1\times10^{-7}$ cm/sec. relative to the flow of water and may ideally be as low as $1\times10^{-15}$ cm/sec.

A relatively high permeability core material 46 such as sand, geonet, geotextile, textured sheet, or other open-pore material having a permeability greater than approximately $1\times10^{-3}$ cm/sec. relative to water is encapsulated between first and second membranes 42, 44. Opposed first and second surfaces of permeable core material 46 are preferably (but not necessarily) connected to the inner surfaces of first and second membranes 42, 44 respectively to resist the effective tensile and compressive stresses between membranes 42, 44. If the effective normal stress between membranes 42, 44 is negative, then the membranes will tend to separate. To resist potential bursting, the mechanical connection established by connecting core material 46 to membranes 42 and 44 must be capable of withstanding an average tensile stress which is equal to the effective normal tensile stress between the membranes. Alternatively, if the effective normal stress between membranes 42, 44 is compressive, then permeable core material 46 is subjected to compressive stress which it must be able to withstand without crushing to the extent that the permeability of core material 46 is reduced to the point that fluid pressure cannot be distributed throughout the region between membranes 42 and 44.

A pressurizing means such as pump 45 is used to introduce a pressurized fluid such as air, water, or other environmentally acceptable fluid into the region encapsulated between first and second membranes 42, 44. The highly permeable core material 46 allows the pressurized fluid to distribute throughout the region encapsulated between membranes 42, 44. To further facilitate distribution of pressurized fluid throughout the region between membranes 42, 44 fluid distribution conduits 58 may be placed within or adjacent to core material 46. Conduits 58 may comprise slotted or perforated pipes, channels or other conduit material suitable for fluid transmission. If the pressure within the region between membranes 42, 44 is maintained so that it exceeds both $P_1$ and $P_2$, then any leakage of fluid through disruptions caused by holes or weld/seam imperfections in either of membranes 42, 44 will consist of escapement of environmentally acceptable pressurizing fluid from the region between membranes 42, 44 into the region which contains fluid 16, or into region 20. More particularly, leakage of fluid 16 into the region between membranes 42, 44 is prevented by maintaining the pressure within that region in excess of $P_1$, thereby preventing escapement of fluid 16 through liner 38.

Figure 10A:
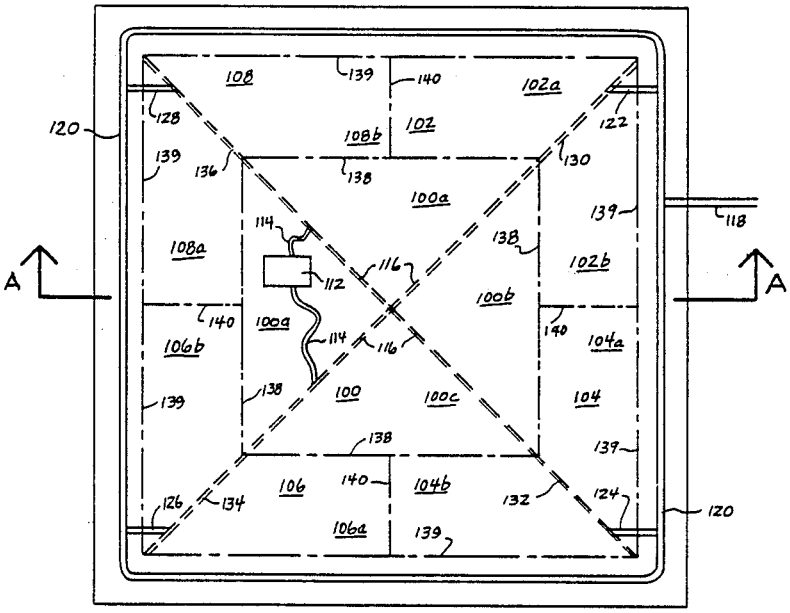
Figure 10B:
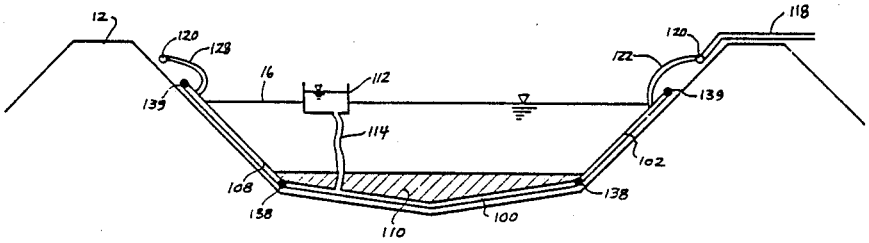

The pressurizing means may alternatively be a floating constant head apparatus 112 of the type depicted in FIGS. 10*a* and 10*b* and capable of applying a constant low positive head fluid pressure within the region between membranes 42, 44. Such apparatus could be allowed to float on the surface of fluid 16 to maintain a small differential overpressure (less than 2 psi.) within the region between membranes 42, 44 independent of the level of fluid 16 above liner 38. This slight overpressure would require only a small coverload to be maintained on upper membrane 42 (for example, by placing a shallow layer of soil or gravel on top of upper membrane 42) sufficient to prevent membranes 42, 44 from separating, in which case the cost and labour involved in establishing a mechanical connection between core material 46 and membranes 42, 44 may be avoided.

In many cases, the pressurized fluid introduced into the region between membranes 42, 44 will preferably be a gas such as air so as to ensure uniform pressurization throughout the encapsulated region. Gas pressurization is particularly well suited to situations where a drainage layer such as a leachate collection system of the sort typically employed at land fill sites is installed above the uppermost liner membrane. In such situations, the contained fluid exerts only a low pressure head $P_1$ on the upper liner surface which can easily be offset by a higher gas pressure within the liner. Gas pressurization is also preferred in situations where introduction of additional fluids of any sort into fluid 16 cannot be permitted; or where introduction of fluid of any sort into region 20 is undesirable.

Figure 11:
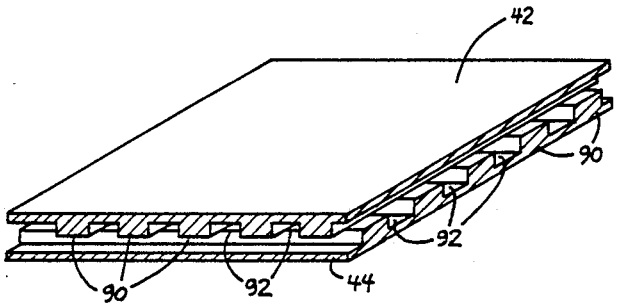
FIG. 11 illustrates the manner in which the inner surfaces of the membranes comprising a liner constructed in accordance with the invention may be channelled or otherwise textured such that contact between the membrane inner surfaces does not obstruct fluid flow between the membrane inner surfaces.

Core material 46 is not essential. One need only ensure that a region of relatively high permeability is encapsulated between membranes 42, 44. For example, as an alternative to the provision of core material 46, the inner surfaces of membranes 42, 44 may be channelled as shown in FIG. 11. Ridges 90 which separate channels 92 in each of membranes 42, 44 contact one another and hold the membranes away from channels 92, thereby ensuring that contact between the membrane inner surfaces does not obstruct fluid flow within channels 92. It is expected that channelled membrane material may be easily and inexpensively fabricated in large quantities and that liners may be easily and inexpensively constructed of such material due to the elimination of the core material. It is also expected that the inner surfaces of channelled membrane material may be more easily and inexpensively connected together to resist bursting of the pressurized liner than would be the case if core material were disposed between the membranes, since both sides of the core material must be connected to the inner membrane surfaces. Instead of channelling the membrane material as shown in FIG. 11, it may be striated, stippled, rippled, or otherwise manufactured with a randomly textured surface such that the inner surfaces of adjacent textured membranes are supported away from one another to prevent obstruction of fluid flow within the region encapsulated by the membranes.

A further alternative liner fabrication technique would be to pass a sheet of relatively high permeability material between a pair of heated rollers to seal the outer surfaces of the material against fluid permeability and then seal the material around its outer edges to encapsulate the high permeability material. Surface sealants or other methods of developing low permeability characteristics in the outer surfaces could be used instead of passage between heated rollers. In the context of this application the term "low permeability membrane" includes a material surface in which low permeability characteristics have been developed as aforesaid. An advantage of this technique is that it eliminates entirely the difficult process of connecting a discrete encapsulated high permeability core material to the membrane inner surfaces, or connection of textured membrane inner surfaces to each other.

Techniques for Joining Liner Panels

Figure 5:
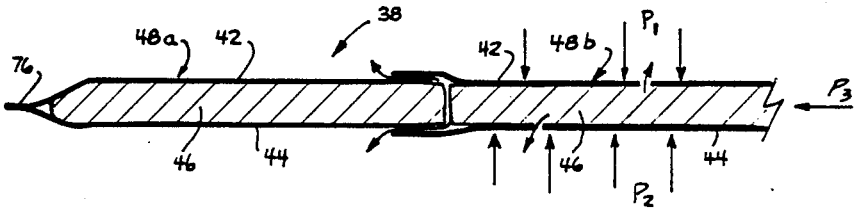
FIG. 5 is a somewhat enlarged cross-sectional side view of a portion of the liner of FIG. 4.

FIG. 5 provides a more detailed cross-sectional side view of a portion of a dual membrane pressure barrier liner 38 employing encapsulated core material 46. Adjacent liner panels 48*a*, 48*b*, etc. each comprise first and second membranes 42, 44 as in the embodiment of FIG. 4. A relatively high permeability core material 46 is encapsulated between first and second membranes 42, 44 and has first and second surfaces which are preferably (but not necessarily) connected to first and second membranes 42, 44 to resist the effective tensile and compressive stresses aforesaid. Adjacent liner panels 48*a* and 48*b* are joined together by overlapping and sealing together adjacent edges of the first membranes 42 of each of panels 48*a* and 48*b* and by overlapping and sealing together adjacent edges of the second membranes 44 of each of panels 48*a*, 48*b*. This method of joining panels 48*a*, 48*b* facilitates fluid communication between the regions between first and second membranes 42, 44 of each of panels 48*a*, 48*b*. Such fluid communication enables distribution of pressurized fluid between adjacent liner panels, thereby reducing the need for separate conduits for distributing pressurized fluid throughout the liner. Membranes 42, 44 of the outermost liner panels are sealed together around their outer edges 76 to prevent loss of pressurized fluid and to encapsulate core material 46.

Figure 7A:
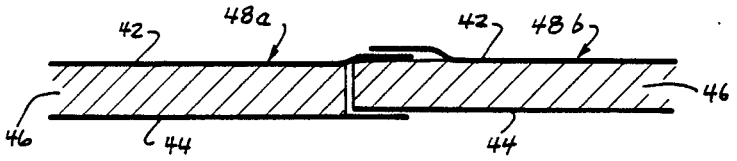
Figure 7B:
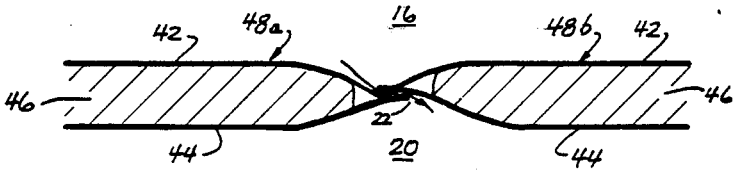

FIGS. 7*a* through 7*j* illustrate a variety of alternative techniques by means of which adjacent liner panels 48*a*, 48*b* may be joined together. For example, FIG. 7*b* shows a lap joint in which the outer edges of membranes 42, 44 of each panel 48*a*, 48*b* are joined together along their inside surfaces before the two panels are joined together by joining the lower surface of the lower membrane 44 of panel 48*b* to the upper surface of the upper membrane 42, of panel 48*a*. By injecting pressurized fluid into the encapsulated region between membranes 42, 44 of each of panels 48*a*, 48*b* the seal and potential leakage from each panel can be checked and leakage through each panel can be prevented as described above. However, a flow path 22, could exist through the joint between the two panels, through which leakage of fluid 16 into region 20 could occur which would not be prevented or detected by injection of pressurized fluid into the region encapsulated between membranes 42, 44. Accordingly, joints of the type shown in FIG. 7*b* should be avoided in preference to joints of the type shown in FIG. 7*a* and 7*c*–7*j*.

Figure 7C:
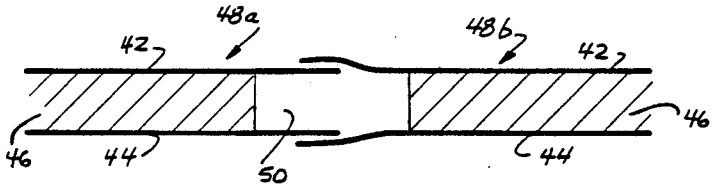
Figure 7D:
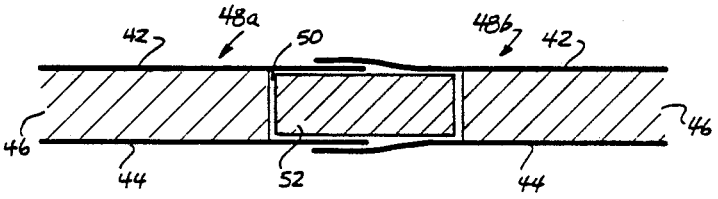

FIGS. 7*c* and 7*d* illustrate the manner in which high permeability material 46 within each of panels 48*a*, 48*b* may be inwardly recessed to leave a gap 50 between the overlapped, sealed panel edges. The gap serves as a flow conduit for distribution of pressurized fluid throughout the liner. As shown in FIG. 7*d*, gap 50 may be filled with an insert 52 formed of the same high permeability material disposed between the membranes comprising each of liner panels 48*a*, 48*b* to provide continuity of core material 46. Alternatively, gap 50 may receive a conduit insert which serves as a means for fluid communication between the regions within adjacent liner panels, as hereinafter explained with reference to FIG. 8.

FIGS. 7*e* and 7*h* illustrate lap joints which may in some situations be preferred to the butt joints illustrated in FIGS. 7*a* and 7*c* through 7*d*. More particularly, FIG. 7*e* shows how the first membrane 42 of each of liner panels 48*a*, 48*b* may comprise a single continuous membrane. The second membranes 44 of each of liner panels 48*a*, 48*b* may each then comprise discrete membranes which are overlapped in the manner shown in FIG. 7*e*. The joint shown in FIG. 7*e* isolates and facilitates separate pressurization and testing of the region encapsulated within liner panels 48*a* and 48*b* respectively. If pressure testing of both encapsulated regions (conducted in the manner hereinafter explained) indicates that there are no leaks from either encapsulated region, then fluid 16 cannot leak through the liner to region 20. The joint of FIG. 7*e* is therefore advantageous for the prevention and detection of leaks, as compared with the lap joint in FIG. 7*b* and may be used to establish isolated sections (cells) in the liner.

FIG. 7*h* illustrates a lap joint in which the outer edges of membranes 42, 44 of each of panels 48*a* and 48*b* are joined together along their inside surfaces before the two panels are overlapped to produce a third high permeability material filled space 56 between panels 48*a* and 48*b*. The edges of space 56 are sealed by joining the under surface of the lower membrane 44 of panel 48*b* to the upper surface of the upper membrane 42 of panel 48*a* at the outer edges of panel 48*b* and by joining the upper surface of the upper membrane 42 of panel 48*a* to the lower surface of the lower membrane 44 of panel 48*b* at the outer edges of panel 48*a* as shown at 64. The regions encapsulated within each of panels 48*a*, 48*b* and region 56 may each be pressurized to prevent leakage of fluid 16 into region 20 and to facilitate detection (as hereinafter described) of such leakage.

Dual Membrane Depressurized Liner

Figure 6:
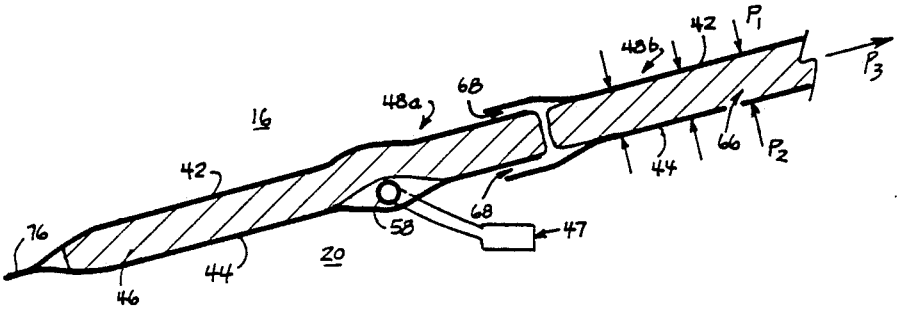
FIG. 6 is a cross-sectional side view of a portion of a dual membrane depressurized liner.

FIG. 6 illustrates a dual membrane liner which is generally similar to the liner described above with reference to FIGS. 4 and 5, except that the pressurizing means is replaced with a depressurizing means such as a vacuum pump 47 for depressurizing the region encapsulated between first and second membranes 42, 44 to pressures below ambient air pressure, and except that high permeability core material 46, if used, need not be connected to membranes 42, 44 as it preferably (though not necessarily) is if the liner is pressurized. In the depressurized liner of FIG. 6, fluid distribution conduits 58 (which are preferably, although not necessarily provided) function as a liquid drainage means and extend throughout the region between first and second membranes 42, 44. The depressurizing means is coupled to liquid drainage conduit 58 and is operated to maintain the region encapsulated between first and second membranes 42, 44 at a pressure which is less than both $P_1$ and $P_2$. Accordingly, any liquids which pass through disruptions caused by holes or seam/weld imperfections in membranes 42 or 44 are drawn toward drainage conduit 58 and eventually pass into conduit 58, through which they are ultimately removed and/or returned to the containment pond.

In the absence of water or other liquid fluid pressures on either side of the liner there will still be ambient air pressure acting on the outer surfaces of membranes 42, 44. Depressurization of the region encapsulated between membranes 42, 44 results in an inflow of air at holes 66 in the membranes, or at seam/weld imperfections 68, thus preventing or reducing the potential for outflow of liquids. More particularly, fluid 16 cannot escape through the liner into region 20 because the pressure gradient established by the depressurizing means ensures that any fluid flow through disruptions in the liner will be from the region outside the liner to the region within the liner and ultimately out of that region via drainage conduit 58. Drainage conduit 58 may comprise geotextile, geonet, slotted pipe, "egg crate waffle" molded conduits or channels, sand, gravel, or other suitable known drainage ducts or materials.

The dual membrane depressurized liner of FIG. 6 (and possibly also the dual membrane pressurized liner of FIGS. 4 and 5) may incorporate first and second layers of geotextile material (not shown) disposed above and below the liner to inhibit passage of particulate matter toward the liner which might clog the region encapsulated between the membranes, drainage conduit 58, the vacuum pump, or otherwise interfere with proper operation of the liner.

Liner Leakage Detection

Significantly, even very small leakage rates may be detected with the aid of the dual membrane liners of FIGS. 4–6. For example, in the pressurized liner of FIGS. 4 and 5, the rate at which pressurizing fluid must be injected into the region encapsulated between first and second membranes 42, 44 to maintain the pressure in that region constantly above $P_1$ and $P_2$ is a measure of the rate at which fluid is escaping by leakage through either of first or second membranes 42, 44. If this leakage rate is sufficiently low then it may not be necessary to operate the pressurizing means continuously (although it may in some cases be desirable to couple a liquid drainage means to conduits 58 in order to remove liquids which may accumulate within the liner during periods when the pressurizing means is not operated). Similarly, with regard to the depressurized liner of FIG. 6, the rate at which the depressurizing means must be operated to maintain the pressure in the region encapsulated between first and second membranes 42, 44 at a constant level which is below $P_1$ and $P_2$ is a measure of the rate at which fluid is leaking through either of first or second membranes 42, 44. Here again, if the measured leakage rate is sufficiently low then it will not be necessary to continually operate the depressurizing means to maintain a reduced pressure (i.e. suction) between first and second membranes 42, 44. Suitable pressure sensing means and/or fluid flow rate sensing means may be employed to sense the fluid pressure in to or out of the region between membranes 42, 44 or to sense the rate of fluid flow within that region, thereby providing an indication of the leakage rate. Moreover, fluid flow rate sensing means for sensing fluid flow rates within the encapsulated region may be employed to measure the flow direction and/or velocity of fluid flow within the encapsulated region and thereby pinpoint leaks. A plurality of pressure sensing means may be employed to detect pressure gradients within the encapsulated region as a further leak location technique. A still further leak detection technique would be to pressurize the liner with a detectable gas or liquid, and then inspect the liner, or the material above the liner, either visually, or with apparatus specially adapted to detect low concentrations of that gas or liquid, thus assisting in pinpointing leaks. This technique facilitates detection of leakage in liners which are either uncovered or which are covered by liquids or by permeable solids (i.e. the technique may be employed to detect leakage in liners which have been placed in service).

Dual membrane liners which are ultimately intended to operate as either pressurized or depressurized liners may be tested before they are placed in service by pressurizing the encapsulated region (or regions in the case of liners having a plurality of liner panels) and then monitoring the pressurized liner as above to detect leakage therefrom. Upon detection of such leakage a sealant may be injected into the encapsulated region. The leakage of pressurizing fluid through holes or weld/seam imperfections will carry the sealant to the leakage sites and into the holes or weld/seam imperfections, thereby effectively plugging them. It may be necessary to provide sealant injection points and vents at multiple locations on the liner so that sealant can be applied uniformly throughout the liner.

Connecting Strip

Figure 8B:
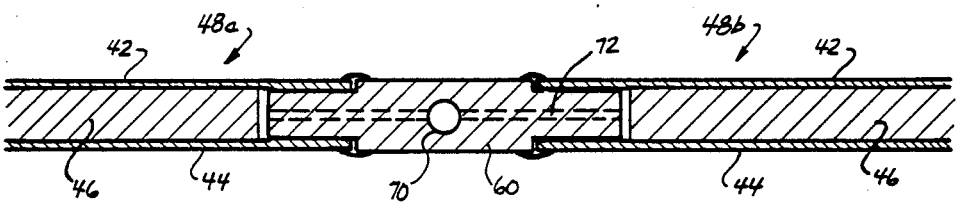
FIG. 8*b* is a cross-sectional view with respect to line A—A of FIG. 8*a*.
Figure 8A:
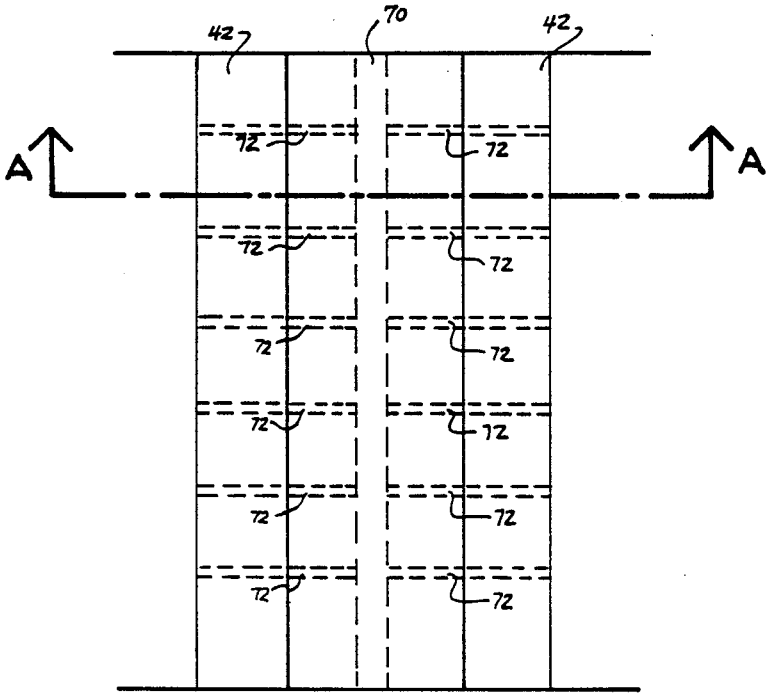
FIGS. 8*a* and 8*c* are, respectively, diagramatic top plan illustrations of a portion of a dual membrane liner incorporating alternative embodiments of a connecting strip for selective fluid communication between regions within adjacent liner panels and for sealingly engaging the edges of the first and second membranes of adjacent liner panels.

FIGS. 8*a* and 8*b* illustrate a "conduit means" or connecting strip 60 which may be formed of suitable rigid or semi-rigid material and to which first and second membranes 42, 44 of adjacent liner panels 48*a*, 48*b* may be sealed with the aid of suitable mechanical connectors, heat welding, solvent welding, adhesive bonding or other known joining techniques. Connecting strip 60 may include a major aperture 70 which extends longitudinally through conduit 60 and a plurality of branch apertures 72 which extend at an angle to aperture 70. When connecting strip 60 is sealed in place between adjacent liner panels 48*a*, 48*b* apertures 70, 72 facilitate fluid communication between the encapsulated regions within each of liner panels 48*a*, 48*b*. If apertures 70 and 72 are omitted from connecting strip 60 then connecting strip 60 serves as a barrier to flow between the encapsulated regions within each of liner panels 48*a*, 48*b*. By joining adjacent liner panels using connecting strips with or without apertures 70, 72 the overall liner can be selectively separated into cells in which the encapsulated regions within particular liner panels are in fluid communication with or, alternatively, are isolated from fluid communication with the encapsulated regions within adjacent panels.

Connecting strip 60 facilitates rapid construction of liners and also eases the ordinarily difficult task of joining segments of liner material together, thus minimizing the occurrence of liner disruptions due to imperfect welds and/or seams. Connecting strip 60 may be utilized in either pressurized or depressurized liners. That is, pressurizing fluid may be injected through apertures 70, 72 to pressurize liner panels sealed along either side of connecting strip 60. Alternatively, a depressurizing means may be used to depressurize the liner panels by withdrawing fluid from within the liner panels through apertures 70, 72.

Figure 9A:
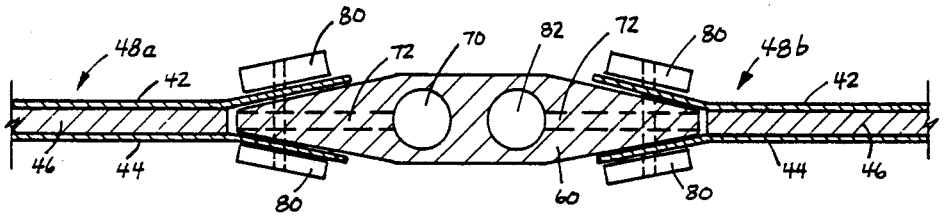
FIGS. 9*a* through 9*d* are, respectively, cross-sectional end views of alternative connecting strips.

Apertures 72 may in some cases be omitted from either or both sides of connecting strip 60 to prevent fluid communication from aperture 70 to either or both of the liner panels sealed along each side of strip 60. This facilitates isolation of selected liner panels as aforesaid for the establishment of liner cells of different pressures, or, if desired, establishment of separate pressurized and depressurized cells within the same liner and even facilitates the use of different pressurizing and/or depressurizing fluids within the same liner. Similarly, as shown in FIG. 9*a*, connecting strip 60 may be provided with a second longitudinal aperture 82 parallel to aperture 70. Aperture 70 may be connected to a series of apertures 72 along one side of strip 60, while aperture 82 is connected to an opposed series of apertures 72 along the opposite side of strip 60. This also facilitates isolation of liner panels sealed along the opposed sides of strip 60 which may then be independently pressurized or depressurized as above.

Figure 8D:
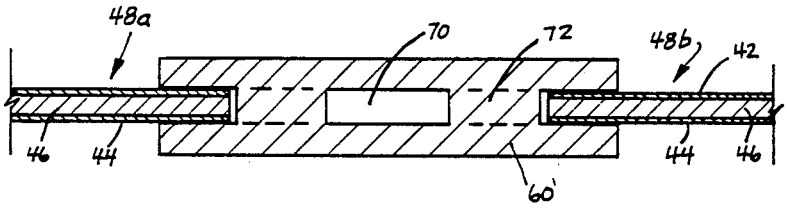
FIG. 8*d* is a cross-sectional view with respect to line B—B of FIG. 8*c*.
Figure 8C:
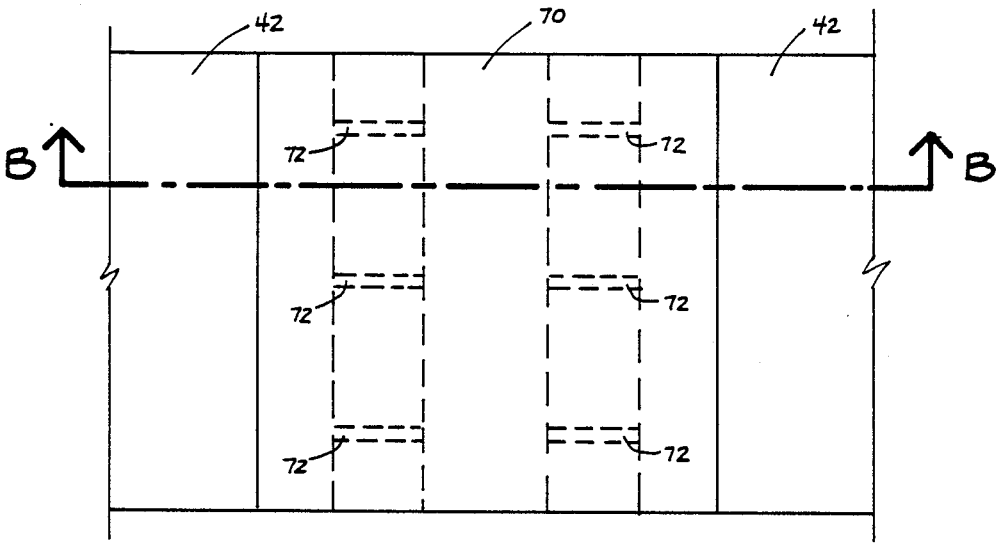
Figure 9B:
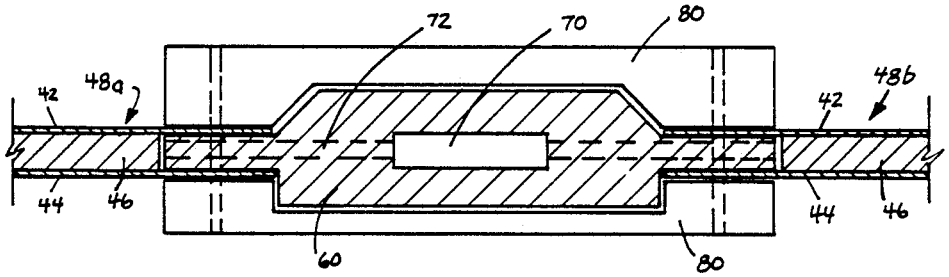

Although FIGS. 8*a* and 8*b* show sealing of liner panels 48*a*, 48*b* to connecting strip 60 by overlapping membranes 42, 44 on strip 60 it may in some cases be convenient to seal the edges of liner panels 48*a*, 48*b* within grooves provided along opposed sides of an alternative strip 60' as shown in FIGS. 8*c* and 8*d*. For example, if permeable core material 46 extends to the outermost edges of liner panels 48*a*, 48*b* then the liner panel edges will be relatively rigid and easily insertable into the grooves for subsequent sealing therein. To add mechanical strength, strips 80 (FIGS. 9*a* and 9*b*) of plastic or other rigid material may be laid over the edges of connecting strips 60 and secured by bolting or riveting through strips 60 and 80. It will also be understood that a plurality of connecting strips 60 may be sealed together in end to end fashion or may be connected or fabricated in "T" or other convenient shapes so as to facilitate construction of liners of any desired size or shape. FIGS. 1O*a* and 10*b* illustrate a liner formed by sealing a plurality of liner panels together with connecting strips so as to provided a "custom" liner of a shape and size which will fit a particular containment pond excavation.

A particular advantage of the invention, as compared with prior art liners employing drainage layers, is that such prior art liners necessitate the provision of a containment pond excavation having a floor which slopes uniformly toward a sump located at the low point of the floor. The cost of constructing such facilities can be high and it is thus expected that considerable time, labour and cost may be saved in terms of construction and floor preparation through exploitation of the invention, which does not require a uniformly sloped excavation floor or sump.

Figure 9C:
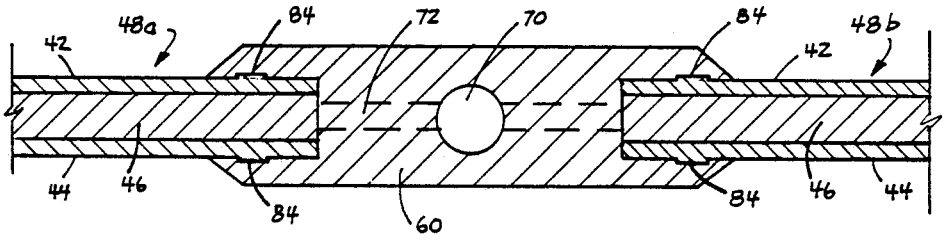

FIG. 9*c* illustrates a connecting strip 60 having grooves along opposed sides thereof for receiving liner panels 48*a*, 48*b* in the manner explained above, and also having thin metallic conductor strips 84 which extend along the opposed inner surfaces of each groove to contact membranes 42, 44 of each liner panel. In a process known as electro-magnetic welding, a short duration pulse of high voltage current is applied to conductor strips 84 to heat them and melt the adjacent portions of membranes 42, 44 which, as they cool, are effectively welded within the connector strip grooves, thereby simplifying the time, cost and labour required to secure liner panels 48*a*, 48*b* to connector strip 60.

Figure 9D:
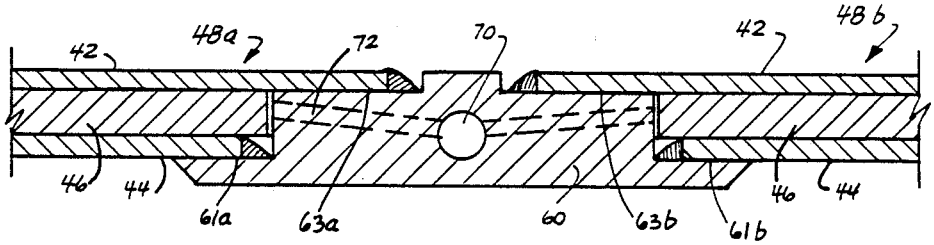

FIG. 9*d* illustrates a connector strip 60 having staggered lips 61*a*, 61*b*, 63*a*, 63*b* along opposite sides of one surface thereof. Lips 61*a* and 61*b* are for sealingly engaging membranes 44 of adjacent liner panels and lips 63*a*, 63*b* are for sealingly engaging membranes 42 of the panels. The advantage of this configuration is that the operation of sealing each of membranes 42, 44 to connector strip 60 may be carried out from above the strip—it is not necessary to turn the strip or the partially completed liner over to complete the sealing operation. Strip 60 of FIG. 9*d* is thus very convenient to use and assists in minimization of leakage at the juncture of the liner panels and connector strips.

Shingling Construction Technique

Figure 12:
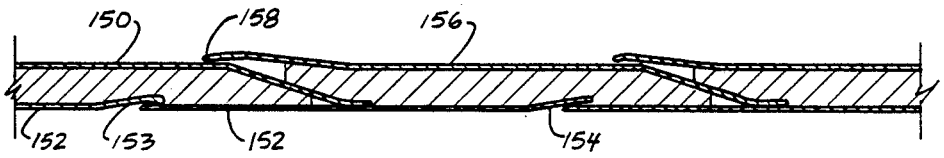
FIG. 12 illustrates a "shingling" technique for constructing and progressively testing a liner in accordance with the invention.

FIG. 12 illustrates a "shingling" technique for constructing and progressively testing a liner. This technique is expected to be extremely effective for construction of liners having minimal leakage characteristics. The technique uses overlapping joints to seal sections of membrane material together to form a continuous liner having a plurality of encapsulated high permeability regions segregated from one another. Undesirable lap joints like that shown in FIG. 7*b* are avoided. A first low permeability membrane 150 is laid above a second low permeability membrane 152 placed upon the floor of the containment pond excavation which is to be lined. Membrane 152 has a larger surface area than membrane 150 (if need be, membrane 152 is constructed by overlappingly sealing, as at 153, two or more sheets of low permeability membrane material). Membrane 150 is joined around its edges to membrane 152 to encapsulate a region of relatively high permeability between the two membranes. (If desired, high permeability core material may be placed in the encapsulated region, or the membranes may be textured as hereinbefore described. Also, depending upon the pressure to be maintained within the encapsulated region, the inner surfaces of the membranes may be connected together, or connected to any encapsulated core material, before the membranes are joined around their edges). The encapsulated region is then pressurized and monitored to detect leakage therefrom. Any leaks detected are repaired; if need be by separating the membranes or, if desired, by injecting sealant material into the encapsulated region to plug the leaks. Membrane 152 is then extended by sealing an edge thereof to a further section of low permeability membrane material as shown at 154. A further section of low permeability membrane material 156 is then sealed to membrane 150 with edge 158 of section 156 overlapping the joint of membranes 150, 152. The remaining edges of membrane 156 are then sealed to the extended lower membrane to encapsulate another high permeability region between membrane 156 and the extended lower membrane. The newly encapsulated region is then pressurized, monitored for leaks and repaired as required. The process is repeated by further extending the lower membrane and overlapping or "shingling" low permeability membrane sections thereabove until the liner attains its desired size and shape. A particular advantage of this technique is that all membrane sealing operations may be conducted from above the liner, thereby simplifying construction. Moreover, if the rightmost edge (as viewed in FIG. 12) of each of the upper membrane sections are only temporarily sealed to the lower membrane (i.e. with tape) then the membranes may easily be separated for repair if leaks are detected and then permanently resealed. However, such temporary sealing may entail problems which outweigh its theoretical advantage aforesaid.

Figure 13:
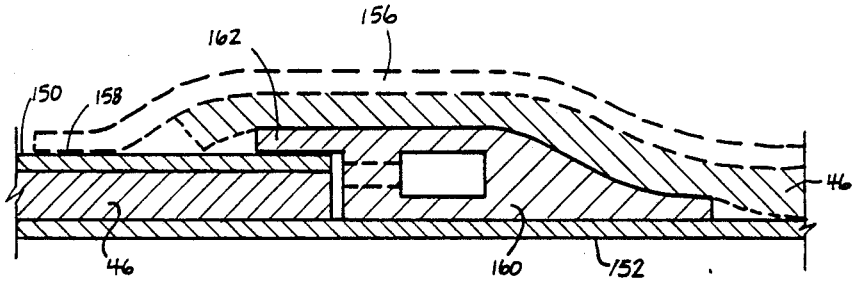
FIG. 13 illustrates a connector strip which is specially adapted to the construction of liners in accordance with the "shingling" technique of FIG. 12.

FIG. 13 illustrates a connector strip 160 specially adapted to the construction of liners in accordance with the shingling technique of FIG. 12. The base of connector strip 160 is sealed directly to the upper surface of lower membrane 152 along the site of the desired joint. The upper surface of membrane 150 is then sealed to the undersurface of lip 162 which projects to the left of strip 160 as viewed in FIG. 13. Membrane 156 and any encapsulated core material 46 is then laid over the top of strip 160 and joint 158 is made by sealing the undersurface of membrane 156 to the upper surface of membrane 150.

Multiple Cell Dual Membrane Liner

FIGS. 1O*a* and 1O*b* show how the bottom of a containment pond may be lined with a low cost dual membrane liner 100 comprised of membranes which need not be mechanically connected to each other or to any high permeability core material which may be encapsulated between the membranes. Bottom liner 100 is joined, around its edges, to a plurality of liner panels or cells 102, 104, 106 and 108 laid against the sloping side walls of the containment pond (liner panels 102, 104, 106 and 108 are each "L" shaped as viewed in FIG. 1O*a*). Side wall liner panels 102, 104, 106 and 108 preferably comprise dual membranes which are mechanically connected to each other or to any high permeability core material which may be encapsulated between the membranes. A low pressure coverload applied to pond bottom liner 100 by a thin covering layer of granular material 110 prevents the opposed membranes comprising pond bottom liner 100 from separating. Moreover, if the density of the pressurizing fluid within side wall liner panels 102, 104, 106 and 108 is about the same as the density of the fluid to be contained by the liner (assuming pressurization of the side wall liner panels) then only a small positive differential pressure head need be maintained within the side wall liner panels and the mechanical connection between the membranes comprising the side wall liner panels or between those membranes and any high permeability core material within the side wall liner panels need only be capable of resisting relatively small tensile forces, which implies lower cost as well.

Note that the individual liner panels 100, 102, 104, 106 and 108 may be independently pressurized or depressurized. For example, a low pressure device such as floating low positive differential pressure head device 112 may be used to pressurize pond bottom liner 100 via flexible hoses 114 coupled to conduits within connecting strips 116 which join together liner panels 100*a*, 100*b*, 100*c* and 100*d* which together comprise pond bottom liner 100; while a vacuum pump (not shown) is used to depressurize side wall liner panels 102, 104, 106 and 108 via line 118, conduit 120 which encircles the outer periphery of the containment pond and conduits 122, 124, 126 and 128 coupled, respectively, to conduits within connecting strips 130, 132, 134 and 136 which join together liner panels 102*a*, 102*b*; 104*a*, 104*b*; 106*a*, 106*b*; and, 108*a*, 108*b* which together comprise side wall liner panels 102, 104, 106 and 108 respectively. Pond bottom liner 100 is joined around its outer periphery to each of side wall liner panels 102, 104, 106 and 108 by connecting strip 138 which has no conduit therewithin, thereby ensuring that the bottom and side wall liners may be maintained at different pressures. Similarly, there is no need for conduits within connecting strips 139 used to join the outer edges of side wall liner panels 102, 104, 106 and 108 together, since connecting strips 139 function primarily to provide a substantial outer border for the liner. Note however that connecting strips 140 used to join adjacent edges of side wall liner panels 102, 104, 106 and 108 to one another do contain conduits to facilitate pressure equalization throughout the side wall liner panels.

Water will be a preferred pressurizing fluid in many applications, due to its neutral environmental impact and due to the fact that its density will often approximate that of the fluid which is to be contained. However, portions of a water pressurized liner which are exposed above the surface of the fluid contained by the liner may freeze. To circumvent this problem a composite liner having a lower portion (i.e that portion which will remain beneath the surface of the fluid to be contained by the liner) comprised of water pressurized liner panels and having an upper portion comprised of depressurized (i.e. non-liquid containing) or air pressurized liner panels may be employed. For example, pond bottom liner 100 shown in FIGS. 10*a* and 1O*b* may be pressurized with water supplied via device 112, while side wall liner panels 102, 104, 106 and 108 are air pressurized or depressurized. The capability to divide the liner into discrete panels or cells which may be independently pressurized or depressurized is thus a significant advantage.

It is also expected that composite liners constructed in accordance with the invention will be well suited to situations in which the fluid pressure upon the uppermost liner membrane is relatively small due to the incorporation of a fluid drainage/removal system above the liner. In such circumstances a low head air overpressure could be applied to prevent leakage through the liner. The advantage of using air as the liner pressurizing fluid in this case is that its low density results in an essentially uniform low pressure within the liner. If water were for example used as the liner pressurizing fluid then increased overpressures would result within the liner at lower elevations.

Multiple Membrane Liners

Figure 14:
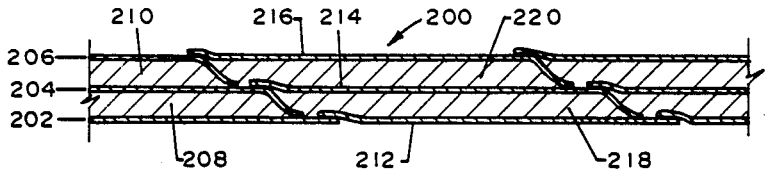
FIG. 14 is a cross-sectional side view of a portion of a triple membrane liner.

Dual membrane liners of the type hereinbefore described may be stacked one above the other to construct multiple membrane liners such that only a single common membrane separates the high permeability regions encapsulated by adjacent membranes. For example, FIG. 14 illustrates a triple membrane liner 200 having first, second and third low permeability flexible membranes 202, 204 and 206 disposed one above the other. Membranes 202, 204 encapsulate a first high permeability region 208 and membranes 204, 206 encapsulate a second high permeability region 210. The shingling technique described above with reference to FIG. 12 is used to extend the liner of FIG. 14 by joining low permeability membranes 212, 214 and 216 to membranes 202, 204 and 206 respectively, thereby encapsulating high permeability regions 218 and 220 between membranes 212, 214 and 214, 216 respectively. Additional membranes are added as required until the liner attains its desired size and shape. The triple membrane liner of FIG. 14 provides an added measure of security in comparison to the dual membrane liners hereinbefore described and also facilitates leakage detection as hereinafter described.

Figure 15:
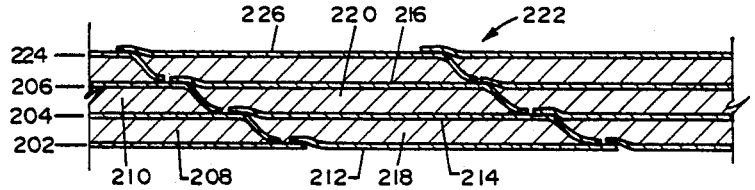
FIG. 15 is a cross-sectional side view of a portion of a quadruple membrane liner.

FIG. 15 shows how the triple liner of FIG. 14 may be extended to yield a quadruple membrane liner 222 by employing the shingling technique hereinbefore described to join additional low permeability membranes 224 and 226 atop membranes 202, 204, 206 and 212, 214, 216 respectively, thus providing a further measure of security and further facilitating liner leakage detection as hereinafter described.

It will thus be understood that a multiple membrane liner may be constructed by providing a first plurality of low permeability flexible membranes disposed one atop the other to encapsulate regions of relatively high permeability between each adjacent pair of membranes. Each one of the membranes in the first plurality can be extended horizontally as required by joining corresponding membranes of a second plurality of low permeability membranes beside that one membrane. The extended membranes lie atop one another to encapsulate further regions of relatively high permeability between each vertically adjacent pair of membranes. It will be understood that construction of a multiple membrane liner having "N" high permeability regions disposed one above the other requires "N+1" low permeability membranes.

Figure 16:
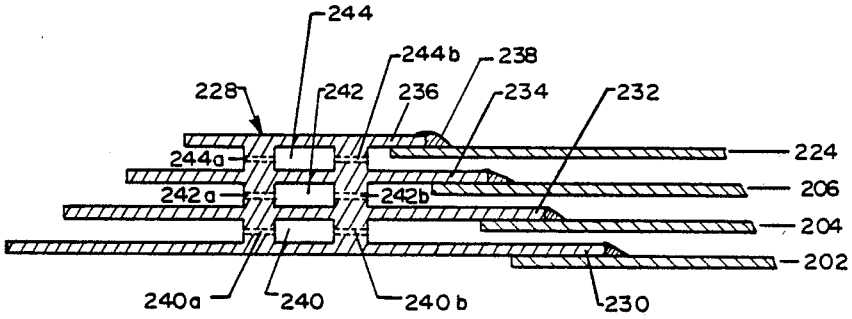
FIG. 16 is a cross-sectional side view of a connecting strip adapted to the construction of multiple membrane liners.

FIG. 16 illustrates how the connecting strip hereinbefore described may be adapted to the construction of multiple membrane liners. More particularly, FIG. 16 illustrates a connecting strip 228 having staggered lips 230, 232, 234 and 236 which may be affixed, respectively, to the upper surfaces of low permeability membranes 202, 204, 206 and 224 of low permeability membrane 222 shown in FIG. 15. Such affixation may be by means of welds as shown at 238 in FIG. 16. Connecting strip 228 is provided with a series of major apertures 240, 242 and 244 each having branch apertures 240*a*, 240*b*; 242*a*, 242*b*; and, 244*a*, 244*b*. When connecting strip 228 is sealed in place between adjacent panels of a quadruple membrane liner, apertures 240, 242 and 244 together with their respective branch apertures facilitate fluid communication between the high permeability regions encapsulated between each adjacent pair of low permeability membranes. This in turn facilitates selective pressurization, depressurization or non-pressurization of the high permeability regions. Those skilled in the art will further appreciate that connecting strips like that illustrated in FIG. 16 may be adapted to the construction of composite multiple membrane liners having groups of cells which may be selectively pressurized, depressurized or left non-pressurized to accommodate specific operating and leak detection objectives by isolating cell groups as aforesaid.

Figure 17:
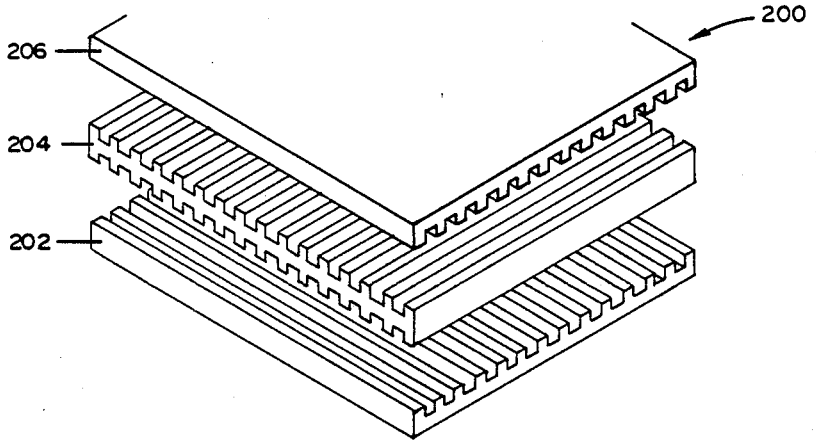
FIG. 17 is similar to FIG. 11, but illustrates a multiple membrane liner.

FIG. 17 illustrates how the inner membrane surfaces of the triple membrane liner 200 of FIG. 14 may be channeled or otherwise textured as described above with reference to FIG. 11 to avoid obstruction of fluid flow between adjacent low permeability membranes.

Figure 18A:
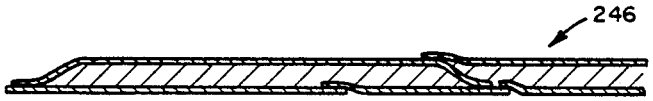
FIGS. 18*a* and 18*b* illustrate two stages in the construction of a multiple membrane liner.
Figure 18B:
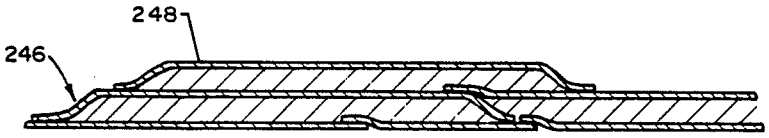

FIGS. 18*a* and 18*b* show two stages in the construction of a triple membrane liner. More particularly FIG. 18*a* shows how a dual membrane liner 246 is first constructed in accordance with the shingling technique described above with reference to FIG. 12. Before construction proceeds further, each of the high permeability regions encapsulated within dual membrane liner 246 is pressurized to a selected pressure and the regions are then monitored to ensure that they each sustain that pressure. If any region fails to sustain the pressure then the two membranes which encapsulate the leaking region are carefully inspected for leaks which are repaired. The pressurization, leakage monitoring, inspection and repair steps are then repeated until all high permeability regions in the dual membrane liner will sustain the selected pressure. It is also advantageous to depressurize each of the high permeability regions encapsulated within dual membrane liner 246 to a selected pressure, monitor the regions to ensure that they maintain the selected pressure and inspect or repair any leaks until all high permeability regions can sustain the selected vacuum pressure. This over and under pressure construction testing technique has the advantage of applying a positive pressure differential to the liner membranes in both inwards and outwards directions. This may reveal leaks which may not be evident under a single pressure differential. The testing verifies the integrity of both liner membranes and all perimeter and intermediate seams of the dual membrane liner. If any particular high permeability region does not maintain the selected test pressure then all of its perimeter welds are easily accessible and can be thoroughly inspected and all leaks therein identified and repaired.

Once the dual membrane liner of FIG. 18*a* has been successfully constructed and tested as aforesaid a third low permeability membrane 248 may be added atop dual membrane liner 246 as shown in FIG. 18*b*. All seams used to weld membrane 248 to dual membrane liner 246 are readily accessible and may be thoroughly inspected and tested by the over/under pressurization technique described above. Further low permeability membranes may then be added atop dual membrane liner 246 and adjacent membrane 248 to extend the liner as required to yield a triple membrane liner of desired size and shape having very secure leakage prevention characteristics.

Those skilled in the art will understand that the same technique may be employed to add still further low permeability membranes atop the triple membrane liner just described to yield a high security multiple membrane liner having "N" high permeability regions encapsulated one atop the other by "N+1" low permeability membranes.

One limitation of a dual membrane liner is that once leakage therefrom is detected (for example, by a need to introduce increased quantities of pressurizing fluid in order to maintain the pressure within the encapsulated high permeability region at a selected level) there is no way of determining which of the upper or lower membranes (or both) are leaking. However, a multiple membrane liner may be operated in a manner which facilitates detection of specific leaking membranes. For example, a detectable fluid may be injected into an encapsulated high permeability region which has failed to maintain a test pressure; and a partial vacuum may be applied to the vertically adjacent high permeability region(s). If the detectable fluid is detected in the drainage from the region(s) to which partial vacuum is applied, then it can be concluded that the membrane between the region into which the detectable fluid was injected and the region from which the detectable fluid was drained is leaking. If no detectable fluid is detected in the drainage from a particular adjacent region then it can be concluded that the membrane between that particular region and the region into which the detectable fluid was injected is not leaking. A further disadvantage of a dual membrane liner is illustrated with reference to FIG. 19 which shows a dual membrane liner comprising upper and lower membranes 250, 252 which desirably prevents contained fluid 254 from passing into the region 256 beneath the liner. If the high permeability region encapsulated between membranes 250, 252 is depressurized and if leaks occur in both membranes then fluids may be drawn into the encapsulated high permeability region and mixed. Such mixing may be undesirable. If the high permeability region encapsulated between membranes 250, 252 is pressurized, then the pressurizing fluid (either liquid or gas) will be forced out of the high permeability region through the membrane leaks and into the containment pond 254 or into the underlying region 256, or both, thus allowing pressurizing fluid to mix with fluid in pond 254 and to mix with ground water in region 256. In either case, such mixing may be undesirable.

Figure 19:
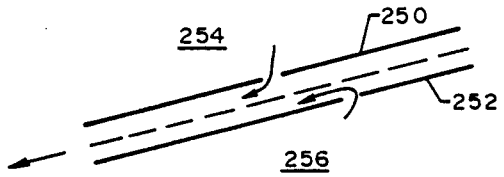
FIG. 19 illustrates the operation of a leaking dual membrane depressurized liner.
Figure 20:
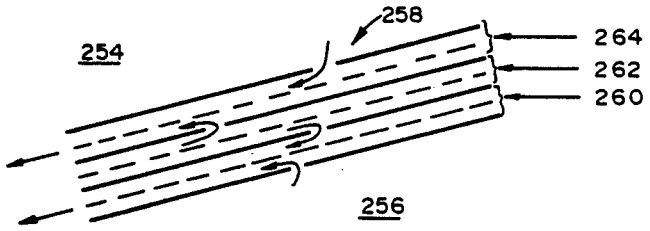
FIG. 20 illustrates the operation of a leaking quadruple membrane liner having depressurized outer segments and a pressurized or non-pressurized inner segment.

FIG. 20 shows how a quadruple membrane liner 258 may replace the liner of FIG. 19 to prevent such undesirable fluid mixing. Quadruple membrane liner 258 encapsulates three separate high permeability regions 260, 262 and 264 respectively. The outer regions 260, 264 are depressurized. The inner region 262 is either pressurized or it may remain non-pressurized. Even if leaks occur in all four of the membranes comprising quadruple membrane liner 258 it is still possible to maintain complete segregation of contained fluid 254 and fluid from the region 256 beneath the liner. Specifically, with a partial vacuum applied to each of regions 260, 264 air is drawn from region 262 through the leaking membranes which encapsulate it, thus preventing flow of fluid 254 (which leaks through the uppermost membrane into region 264) or flow of fluids from region 256 (which leak into region 260 through disruptions in the lowermost liner membrane) into region 262. Moreover, fluid 254 which leaks into region 264 may be drained therefrom and returned to the containment pond (or otherwise handled). Similarly, fluid which leaks into region 260 from region 256 may be drained from region 260, analyzed to confirm that it is uncontaminated and then returned to region 256.

Figure 21:
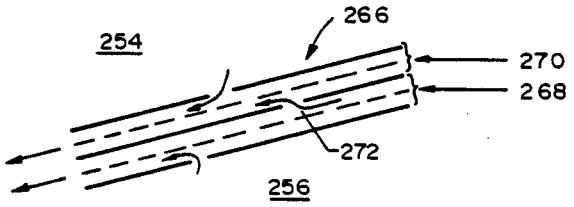
FIG. 21 illustrates operation of a leaking triple membrane liner in which both liner segments are depressurized; the degree of vacuum in the upper liner segment exceeding that in the lower liner segment.

FIG. 21 illustrates a triple membrane liner in which high permeability regions 268 and 270 are both depressurized with the degree of vacuum in region 270 exceeding that in region 268. Should leaks occur in all three low permeability membranes comprising liner 266 then fluid from region 256 is drawn into region 268 and some of that fluid may pass into region 270 as illustrated at 272. However, fluid 254 can only pass into region 270 due to the pressure differential between regions 268 and 270. Analysis of the fluids drained from regions 268 and 270 facilitate confirmation that fluid 254 has not passed into region 268 and that there is accordingly no potential for escapement of fluid 254 into region 256.

Figure 22:
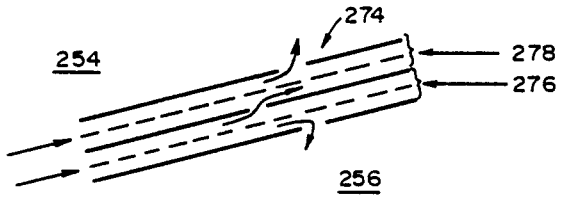
FIG. 22 illustrates operation of a leaking triple membrane liner in which both liner segments are pressurized; the pressure in the lower liner segment exceeding that in the upper liner segment.

FIG. 22 illustrates a triple membrane liner 274 having encapsulated high permeability regions 276 and 278 which are both pressurized; the pressure in region 276 exceeding that in region 278. The contained fluid 254 and fluids in region 256 are both prevented from flowing into regions 276 and 278 by the pressure differential (i.e. the pressures in region 276 and 278 are established such that they exceed the fluid pressures exerted on liner 274 by fluid 254 or fluids in region 256). Moreover, fluid flow from region 278 into region 276 is prevented because the pressure in region 276 exceeds that in region 278. Thus there is a double measure of protection against leakage of fluid 254 into region 256. Fluid in region 278 may be sampled and tested for contamination by fluid 254. If no contamination is detected then it may be concluded that fluid 254 is unable to escape through liner 274 into region 256. If contamination is found in region 278 then the fluid in region 276 may be sampled and tested. If it is found to be uncontaminated then there is still no potential of escapement of fluid 254 into region 256.

Figure 23:
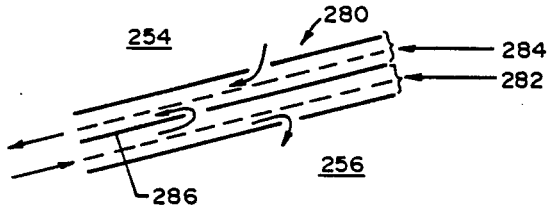
FIG. 23 illustrates operation of a leaking triple membrane liner in which the lower liner segment is pressurized and the upper liner segment is depressurized.

FIG. 23 shows a triple membrane liner 280 which encapsulates high permeability regions 282 and 284 respectively. A pressurizing means is used to pressurize region 282 and a depressurizing means is used to depressurize region 284. Double protection against leakage of fluid 254 into region 256 is thus again provided by the dual pressure differential created across the interior low permeability membrane 286. The fluid in region 282 may be sampled and tested to confirm that there is no leakage of fluid 254 into region 282. All the advantages of a pressurized liner may be obtained in region 282 without leakage of the pressurizing fluid into the zone which contains fluid 254.

Figure 24:
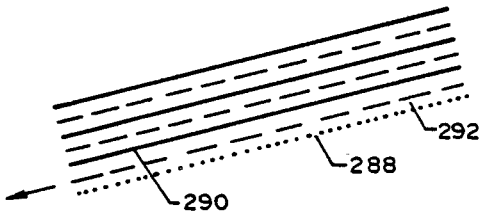
FIG. 24 illustrates the provision of a high permeability flexible membrane beneath the lowermost low permeability liner membrane to facilitate fluid drainage from beneath the liner.

In certain situations it may be necessary or desirable to facilitate fluid drainage from beneath or above a multiple membrane liner, for example either to prevent uplift of the liner in the event of a rapid draw down of the liquid level in the containment zone, or to effect leachate collection from within the containment zone. FIG. 24 illustrates a portion of a multiple membrane liner which provides a capability for under drainage. To construct a multiple membrane liner with an integral under drain, a high permeability membrane 288 is disposed beneath the lowermost low permeability membrane 290 of the multiple membrane liner. High permeability membrane 288 may be formed of any membrane material which is structurally stable such that it will not migrate into the high permeability region 292 created between membranes 288 and 290. Application of a suction to region 292 will result in evacuation and drainage of that region, preventing uplift pressures on membrane 290 and on the multiple membrane liner in general. Similarly, a high permeability membrane may be disposed above the uppermost membrane of a multiple membrane liner to encapsulate a region of relatively high permeability between the high permeability membrane and the uppermost low permeability membrane of the liner. The high permeability region so encapsulated may then serve as a dewatering layer. In some situations it may be desirable to provide high permeability membranes both above and below a multiple membrane liner.

Multiple Membrane Liner Leakage Detection

A technique for detecting leaks during construction of a multiple membrane liner is described above. A generalized technique for detecting leaks in an operating multiple membrane liner will now be described in the context of a quadruple membrane liner which encapsulates high permeability regions "1", "2" and "3".

The test begins by pressurizing (or depressurizing) high permeability region 1 to a selected pressure or by injecting it with a detectable fluid. High permeability region 1 is then monitored to see if it will sustain the selected pressure or contain the detectable fluid. If the test is successful (i.e. if the pressure is sustained or the fluid contained) then it may be concluded that both the membranes which encapsulate high permeability region 1 and their interconnecting seams are sound. If the test fails then it may be concluded that either or both membranes, or one or more of their interconnecting seams are leaking.

High permeability region 2 is then tested in similar fashion. If the test is successful then it may be concluded that the low permeability membranes which encapsulate high permeability region 2 are both sound. Moreover, if the test of high permeability region 2 is successful but the test of high permeability region 1 fails then it may be concluded that the outermost membrane encapsulating high permeability region 1 (i.e. the membrane which is not also common to encapsulation of high permeability region 2) is leaking. If the test of high permeability region 2 is unsuccessful and if the test of high permeability region 1 succeeded then it may be concluded that the outermost membrane encapsulating high permeability region 2 (i.e. the membrane which is not common to encapsulation of high permeability region 1) is leaking. If the tests of both regions 1 and 2 fail then it may be concluded that the common membrane, or two of the three membranes which together encapsulate regions 1 and 2 are leaking. The test then proceeds as follows.

High permeability regions 1 and 2 are tested together by pressurizing them to a selected pressure or by injecting them with a detectable fluid. If the test is successful (i.e. the regions together sustain the selected pressure or contain the detectable fluid) then it may be concluded that the outermost low permeability membranes are sound and that the innermost membrane (i.e. the membrane which is common to encapsulation of both regions) is leaking. If regions 1 and 2 together fail the test then testing proceeds on high permeability region 3.

High permeability region 3 is tested by pressurizing it to a selected pressure or by injecting it with a detectable fluid. If the test is passed (i.e. if high permeability region 3 sustains the selected pressure or contains the detectable fluid) then it may be concluded that the two membranes which encapsulate high permeability region 3, and their interconnecting seams, are both sound. Moreover, if the test of region 1 was passed and the test of region 2 failed then it may be concluded that there is a leak in the perimeter seams of region 2. Alternatively, if the test of region 3 fails and if the test of region 2 passed then it may be concluded that the outermost low permeability membrane (i.e. the membrane which is not common to encapsulation of regions 2 and 3) is leaking. Furthermore, if the test of region 3 fails and if the tests of regions 1 and 2 also failed then it may be concluded that the membrane common to encapsulation of regions 2 and 3; or any three of the four low permeability membranes are leaking. Testing then proceeds as follows.

Regions 1, 2 and 3 are tested together by pressurizing them to a selected pressure or by injecting them with a detectable fluid. If the test passes then it may be concluded that both of the interior membranes (i.e. the membranes common to encapsulation of regions 1 and 2 and encapsulation of regions 2 and 3 respectively) are leaking.

It will be noted that the foregoing procedure facilitates isolation of the leaking membrane(s) only if at least one high permeability region successfully passes the test. If all regions fail the test then it is not possible to determine whether all or all but one of the low permeability membranes are leaking. However, this condition is considered relatively unusual and sufficiently catastrophic that a major overhaul of the liner would be desirable in any event.

As an alternative testing procedure, one may inject a detectable gas or fluid into a particular high permeability region and then attempt to withdraw that gas or fluid from an adjacent high permeability region by applying a partial vacuum to the adjacent region. If no gas or fluid is withdrawn from the adjacent region then it can be concluded that the membrane separating the two regions is not leaking. Note that it is possible that the membrane separating the two regions is not leaking even though either one of the two regions, or the two regions together, fail to maintain a test pressure; due to leakage of other membranes encapsulating the regions in question.

As will be apparent to those skilled in the art, in light of the foregoing disclosure, many alterations and modifications are possible in the practice of this invention without departing from the spirit or scope thereof. Accordingly, the scope of the invention is to be construed in accordance with the substance defined by the following claims.

We claim:

1. A liner comprising:

(a) a first plurality of low permeability flexible membranes disposed one above the other, each vertically adjacent pair of said membranes being sealed about their respective edges to encapsulate a region of high permeability between each of said sealed membrane pairs;

(b) pressurizing means for pressurizing a selected group of said regions to a selected pressure or pressures; and, (c) means for preventing separation of said membranes during pressurization of said regions.

2. A liner as defined in claim 1, further comprising:

(a) a relatively high permeability flexible membrane disposed outside the outermost of said low permeability membranes to encapsulate a further high permeability region between said high permeability membrane and at least one outer surface of said liner;

(b) depressurizing means for depressurizing said further region;

(c) means for maintaining separation of said high permeability and outermost membranes during depressurization of said further region; and, (d) drainage means for withdrawing liquids from within said further region.

3. A liner as defined in claim 1, wherein said high permeability regions each comprise a high permeability material connected between the adjacent membranes which encapsulate said respective regions.

4. A liner as defined in claim 1, wherein said membranes are textured such that contact between said membranes does not obstruct fluid flow within said regions.

5. A liner as defined in claim 4, wherein the adjacent surfaces of membranes which encapsulate said regions are connected together.

6. A liner as defined in claim 1, further comprising:

(a) for each one of said first plurality of membranes, a corresponding membrane of a second plurality of low permeability membranes disposed beside said one membrane; and, (b) separate regions of high permeability encapsulated between each vertically adjacent pair of said second plurality of membranes.

7. A liner as defined in claim 6, further comprising connector means for sealingly connecting edges of said membranes disposed beside one another.

8. A liner as defined in claim 7, wherein said connector means is further for selective fluid communication between encapsulated regions.

9. A liner as defined in claim 1, wherein said pressurizing means comprises a floating constant head apparatus for floating in fluid contained by said liner and for applying a constant low positive differential pressure head within said selected group of regions.

10. A liner comprising:

(a) a first plurality of low permeability flexible membranes disposed one above the other, each vertically adjacent pair of said membranes being sealed about their respective edges to encapsulate a region of high permeability between each of said sealed membrane pairs;

(b) depressurizing means for depressurizing a selected group of said regions to a selected pressure or pressures; and, (c) separator means for maintaining separation of said membranes during depressurization of said regions.

11. A liner as defined in claim 10, further comprising:

(a) a relatively high permeability flexible membrane disposed outside the outermost of said low permeability membranes to encapsulate a further high permeability region between said high permeability membrane and at least one outer surface of said liner;

(b) second depressurizing means for depressurizing said further region;

(c) means for maintaining separation of said high permeability and outermost membranes during depressurization of said further region; and, (d) drainage means for withdrawing liquids from within said further region.

12. A liner as defined in claim 10, wherein said membranes are textured such that contact between said membranes does not obstruct fluid flow within said regions.

13. A liner as defined in claim 10, further comprising drainage means extending within a selected group of said regions, for withdrawing liquids from within said regions.

14. A liner as defined in claim 10, further comprising:

(a) for each one of said first plurality of membranes, a corresponding membrane of a second plurality of low permeability membranes disposed between said one membrane; and, (b) separate regions of high permeability encapsulated between each vertically adjacent pair of said second plurality of membranes.

15. A liner as defined in claim 14, further comprising connector means for sealingly connecting edges of said membranes disposed beside one another.

16. A liner as defined in claim 15, wherein said connector means is further for selective fluid communication between encapsulated regions.

17. A liner as defined in claim 10, wherein said depressurizing means comprises a vacuum pump.

18. A liner, comprising:

(a) a first plurality of low permeability flexible membranes disposed one above the other, each vertically adjacent pair of said membranes being sealed about their respective edges to encapsulate a region of high permeability between each of said sealed membrane pairs;

(b) pressurizing means for pressurizing a first group of said regions to a selected pressure or pressures; and, (c) depressurizing means for depressurizing a second group of said regions to a selected pressure or pressures;

(d) means for preventing separation of said membranes encapsulating said first group of regions during pressurization thereof; and, (e) separator means for maintaining separation of said membranes encapsulating said second group of said regions during depressurization thereof.

19. A liner, as defined in claim 18, further comprising:

(a) a relatively high permeability flexible membrane disposed outside the outermost of said low permeability membranes to encapsulate a further high permeability region between said high permeability membrane and at least one outer surface of said liner;

(b) second depressurizing means for depressurizing said further region;

(c) means for maintaining separation of said high permeability and outermost membranes during depressurization of said further region; and, (d) drainage means for withdrawing liquids from within said further region.

20. A liner as defined in claim 18, wherein said high permeability regions comprise a high permeability material connected between the adjacent membrane which encapsulate said respective regions.

21. A liner as defined in claim 18, wherein said membranes are textured such that contact between said membranes does not obstruct fluid flow within said regions.

22. A liner as defined in claim 21 wherein the adjacent surfaces of membranes which encapsulate said regions are connected together.

23. A liner as defined in claim 18, further comprising drainage means extending within a selected group of said regions, for withdrawing liquids from within said regions.

24. A liner as defined in claim 18, further comprising:

(a) for each one of said plurality of membranes, a corresponding membrane of a second plurality of low permeability membranes disposed beside said one membrane; and, separate regions of high permeability encapsulated between each vertically adjacent pair of said second plurality of membranes.

25. A liner as defined in claim 24, further comprising connector means for sealingly connecting edges of said membranes disposed beside one another.

26. A liner as defined in claim 25, wherein said connector means is further for selective fluid communication between encapsulated regions.

27. A liner as defined in claim 18, wherein said pressurizing means comprises a floating constant head apparatus for floating in fluid contained by said liner and for applying a constant low positive differential pressure head within said first group of regions.

28. A liner as defined in claim 18, wherein said depressurizing means comprises a vacuum pump.

* * * * *